US005377806A

United States Patent [19]

Merchel

[11] Patent Number: 5,377,806

[45] Date of Patent: Jan. 3, 1995

[54] TOKEN- OR CARD-OPERATED LOCK FOR SHOPPING OR LUGGAGE CART

[75] Inventor: Horst Merchel, Bietigheim, Germany

[73] Assignee: Vendoret Holding S.A., Luxembourg-Hesperange, Luxembourg

[21] Appl. No.: 73,141

[22] Filed: Jun. 7, 1993

[30] Foreign Application Priority Data

Jun. 5, 1992 [DE] Germany ..... 4218527

[51] Int. Cl.[6] ..... G07F 17/00

[52] U.S. Cl. ..... 194/212; 194/905

[58] Field of Search ..... 194/205, 212, 905

[56] References Cited

U.S. PATENT DOCUMENTS 4,766,989 8/1988 Maloeuvre et al. ..... 194/905 X
5,199,544 4/1993 Lenander et al. ..... 194/905 X

FOREIGN PATENT DOCUMENTS 0468088 10/1990 European Pat. Off. .
2425682 12/1979 France .
2604010 3/1988 France .
2629122 9/1989 France .
8604174 7/1986 WIPO .
8801084 2/1988 WIPO .
9007167 6/1990 WIPO .

*Primary Examiner*—F. J. Bartuska
*Attorney, Agent, or Firm*—Herbert Dubno; Andrew Wilford

[57] ABSTRACT

A lock system has a housing formed with an outwardly open latch port and an actuating port, a latch member adapted to be inserted into the latch port, an actuator—normally either a card, token, or coin—adapted to be inserted into the actuating port, and a latch element movable between a holding position retaining the latch member against removal from the latch port and a freeing position permitting such removal. A control element is movable on insertion of the actuator into the actuating port from a locked to an unlocked position, and interengageable formations on the elements displace the latch element into the freeing position on displacement of the control element by the actuator into the unlocked position.

15 Claims, 2 Drawing Sheets

TOKEN- OR CARD-OPERATED LOCK FOR SHOPPING OR LUGGAGE CART

FIELD OF THE INVENTION

The present invention relates to a lock for a cart. More particularly this invention concerns such a lock that is operated by a coin, token, or card and that is used on a luggage or shopping cart.

BACKGROUND OF THE INVENTION

It is standard in airports or shopping centers to provide luggage or shopping carts that can only be used by authorized persons having the appropriate card or token. The token or card can be returned to the user once the card is itself returned to the appropriate station. The system is intended to prevent unauthorized persons from using the carts, and ensures that the authorized users will return them to the depot.

Thus as described in my copending application Ser. No. 07/985,676 filed Dec. 4, 1992 and now abandoned, the system comprises a latch member that is pivoted by a chain or cable on a fixed support or another cart and a lock having a slot into which the member can be fitted and in which it is retained until the right token or card is inserted into a slot of the lock. The token or card can only be recovered by the user when a latch member is reinserted into the lock, so that the user must return the cart to the depot in order to recuperate his token or card. Such arrangements are fairly complex, requiring that the token or card be evaluated so that a latching mechanism can be operated. In general they are too complex for use merely to ensure that a cart is returned to the storage depot.

OBJECTS OF THE INVENTION

It is therefore an object of the present invention to provide an improved lock for use with a shopping or luggage cart.

Another object is the provision of such an improved lock for use with a shopping or luggage cart which overcomes the above-given disadvantages, that is which is of extremely simple yet very robust construction.

SUMMARY OF THE INVENTION

A lock system has according to the invention a housing formed with an outwardly open latch port and an actuating port, a latch member adapted to be inserted into the latch port, an actuator—normally either a card, token, or coin—adapted to be inserted into the actuating port, and a latch element movable between a holding position retaining the latch member against removal from the latch port and a freeing position permitting such removal. A control element is movable on insertion of the actuator into the actuating port from a locked to an unlocked position, and interengageable formations on the elements displace the latch element into the freeing position on displacement of the control element by the actuator into the unlocked position.

Thus with this system the token, coin, or card used as actuator directly engages the control element and directly actuates the lock to release the latch member. Thus the user need merely poke his coin, token, or card into the actuating port to free the latch member and make use of the cart carrying the lock.

According to this invention the latch element is pivotal about an axis between its holding and freeing positions. The formations include an eccentric crank on the latch element and an actuating surface on the control element. Alternately the latch element is slidable between its holding and freeing positions.

A spring urges the control element into its unlocked position and the control element is at least partially hollow. More specifically the control element has an abutment face against which the actuator is directly engageable. The housing includes a guide and the control element is of U-section and straddles the guide.

According to a further feature of the invention a retaining element can move in the housing between a holding position preventing withdrawal of the actuator from the actuator port and a freeing position permitting such withdrawal. Interengaging formations on the retaining and control elements displace the retaining element into the holding position on displacement of the control element into the freeing position. Thus the actuator is held in the lock until the latch member is reinserted into the latch port, thereby freeing it. This forces the user to return the cart to the stand where he can reattach it to a lock member and regain custody of the coin, token, or card used as the actuator.

Furthermore a spring is braced between the retaining element and the housing and urges the retaining element into its holding position. The retaining element has a blocking formation engageable with the actuator in the holding position of the retaining element. This blocking formation is a projection engaging through the actuator, for instance through a hole in a token or card functioning as actuator.

The system further has a guide block on which the control and latch elements are displaceable. The control element slides on the guide block and can have an angled cam surface engaging the latch element and formed by a flank of an angled slot cut in the control element.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
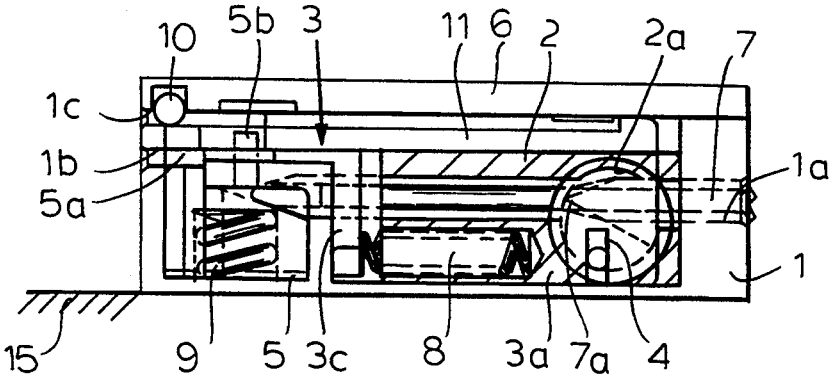
FIG. 1 is a longitudinal section through the lock according to this invention in the locked position.
Figure 2:
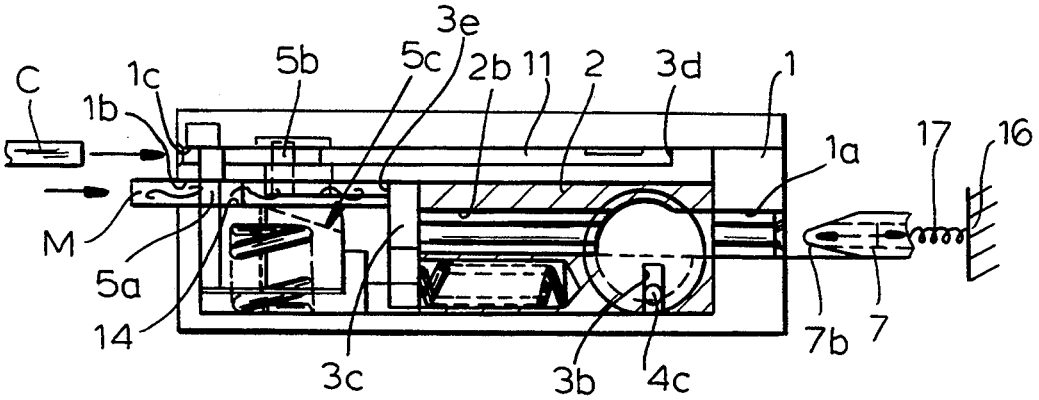
FIG. 2 is a view like FIG. 1 but in the unlocked position.
Figure 3:
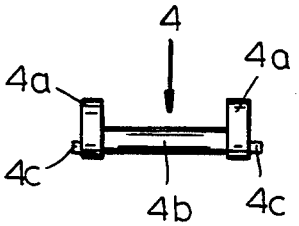
FIG. 3 is a side view of the retaining element.
Figure 4:
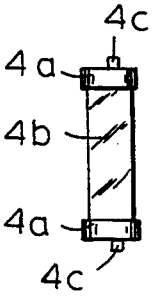
FIG. 4 is another side view of the retaining element.
Figure 5:
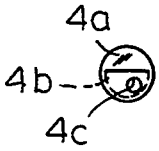
FIGS. 5 and 6 are end views of the retaining element in the unlocked and locked positions, respectively.
Figure 6:
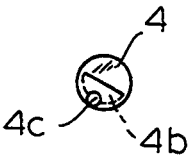

As seen in FIGS. 1 and 2 the lock according to this invention has a housing 1 formed at its longitudinal front end with a forwardly open slot or port 1*a* and at its rear end with a pair of rearwardly open slots or ports 1*b* and 1*c*. A rigid latch member 7 formed on its faces with transverse oppositely open grooves 7*a* is receivable in the port 1*a*, a coin or token M is receivable in the slot 1*b*, and a card shown partially at C in the slot 1*c*. This member 7 is normally secured, for instance by a chain 17, to a support or another cart illustrated schematically at 16. The top of the generally box-like housing 1 is closed by a removable cover plate 6 forming the upper edge of the card slot 1*c* and holding a roller 10 that normally closes this port 1*c* to prevent foreign matter from entering the lock. The housing 1 is normally mounted on the handle or crosspiece 15 of a shopping or luggage cart.

A guide block 2 inside the housing 1 is formed with a crosswise cylindrical seat 2*a* in which is rotatable a latch element 4 and with a longitudinally throughgoing passage or slot 2*b* forming a continuation of the port 1*a* and capable of receiving the rear end of the tongue-like latch member 7. A U-section control element or slide 3 can move on this guide block 2 between the locked position shown in FIG. 1 and the unlocked position of FIG. 2. A compression coil spring 8 braced between a transverse web 3*c* of the element 3 and the block 2 urges the element 3 continuously into the unlocked position.

The latch element 4 shown in FIGS. 3 through 6 comprises a pair of short cylindrical end portions 4*a* journaled in the complementary holes 2*a* of the guide block 2*a*, a semicylindrical and offcenter bar 4*b* extending between the end portions 4*a*, and coaxial but offcenter actuating pins 4*c* projecting oppositely from the outer faces of the end portions 4*a*. The slide 3 has longitudinally extending sides 3*a* that are each formed with a transverse slot 3*b* in which a respective one of the actuating pins 4*c* is provided. Thus as the slide 3 moves longitudinally from the unlocked to the locked position it will pivot the element 4 from the position of FIG. 5 to the position of FIG. 6. In the FIG. 6 position the edge of the bar 4*b* projects partly into the passage 2*b* at the location where the latching-member notch 7*a* is when the latching member 7 is inserted fully into the port 1*a*.

A hollow retaining element 5 is displaceable transversely in the housing 1 and is urged transversely in one direction, here upward, by a coil compression spring 9 braced against the floor of the housing 1. The upper end of this element 4 is provided immediately inward of the port 1*b* with a pair of upwardly projecting laterally spaced projections 5*a*, somewhat inward thereof with a pair of laterally spaced and upwardly projecting pins 5*b*, and further inward with an inclined actuating surface or ramp 5*c* engageable by a beveled tip 7*b* of the latching member 7. The projections 5*a* extend in the unlocked position of FIG. 2 across a slot 14 forming a longitudinal extension of the port 1*b* and delimited in the housing 1 by a longitudinally rearwardly directed face 3*e* of the control slide 3. The pins 5*b* extend in the unlocked position across a slot 11 forming a longitudinal extension of the port 1*c* and terminating at a rearwardly directed face 3*d* of the control slide 3.

If an appropriately dimensioned coin or token M is inserted into the slot 1*b* so that it only projects slightly rearwardly therefrom, it will engage the face 3*e* and push the slide 3 into the unlocked position. A card C similarly inserted into the slot 1*c* will engage the edge 3*d* and also push the slide 3 into the unlocked position.

In the normal locked position of FIG. 1 a latching member 7 is inserted fully into the port 1*a* and passage 2*b*, the retaining element 5 is in the fully up position, and the slide 2 is fully back (to the left) so that the latch element 4 is pivoted and the bar 4*b* engages in the slot 7*a* of the member 7. This solidly retains the member 7 in the housing 1. The beveled tip 7*b* of the member 7 lies against the actuating face 5*c* of the member 5, holding it down against the force of its spring 9 so that the projections 4*a* and pins 5*b* are clear of the respective slots 14 and 11. The housing 1 is mounted normally on the handle of a shopping or luggage cart and the member 7 is typically tethered by a chain to another such cart or to a stationary support, so in the locked position the cart having the housing 1 is locked in place.

Insertion of a token M into the slot 1*b* and against the edge 3*c* or of a card C into the slot 1*c* and against the edge 3*d* pushes the control slide 3 forward. This action rotates the element 4 and pulls the bar 4*b* out of the groove 7*a*, releasing the member 7. Pulling the member 7 forward out of the slot 1*a* releases the member 5 so that its spring 9 can push it up. This brings its projections 5*a* and pins 5*b* across the slots 14 and 11, blocking removal of the token M or card C therein. Thus the token M or card C is retained in the lock so long as the cart is not tethered to a latching member 7.

When the user is finished with the cart, it is returned to the depot and the latch member 7 is pushed back into the slot 1*a*. This action first pushes down the member 5 so as to free the card C or token M, and the spring 8 is then effective to push the slide 3 back, simultaneously ejecting the card C or token M and rotating the element 4 to again lock the member 7 in place. The device is returned to the locked condition.

Figure 7:
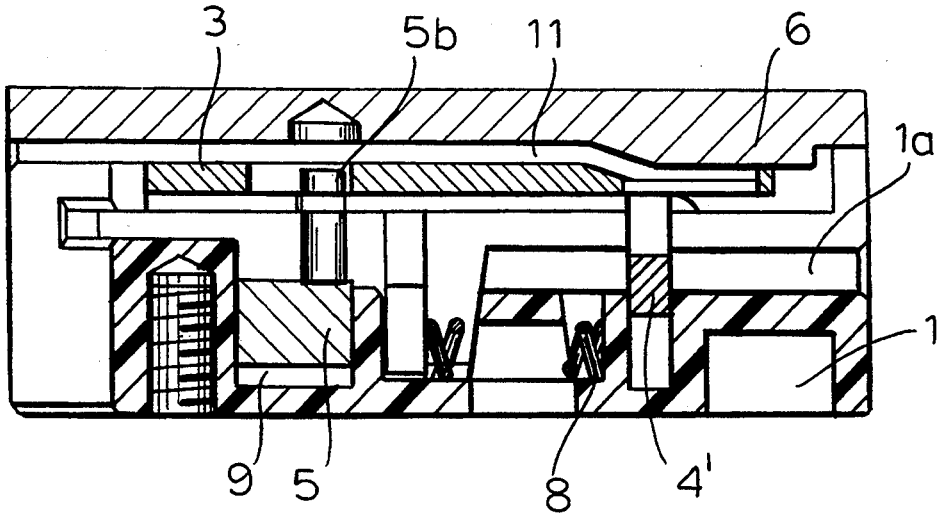
FIG. 7 is a view like FIG. 1 of another system according to the invention.
Figure 8:
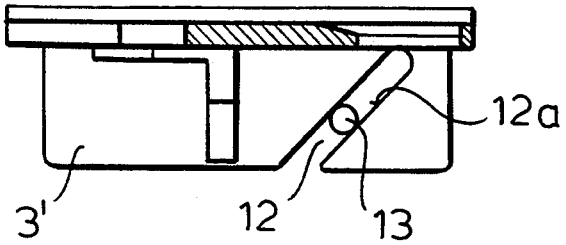
FIG. 8 is a partly sectional view of a detail of FIG. 7.

The system of FIGS. 7 and 8 replaces the rotary element 4 with a slidable element 4' having end pins 13 that ride on a face 12*a* of an angled groove 12 formed in the slide 3'. Otherwise this embodiment functions identically to that of FIGS. 1 through 6.

I claim:

1. A lock system comprising:

a housing formed with an outwardly open latch port and an actuating port;

a latch member adapted to be inserted into the latch port;

an actuator adapted to be inserted into the actuating port;

a latch element pivotable about an axis between a holding position retaining the latch member against removal from the latch port and a freeing position permitting such removal;

a control element movable on insertion of the actuator into the actuating port from a locked to an unlocked position; and means including an eccentric crank on the latch element and an actuating surface on the control element for displacing the latch element into the freeing position on displacement of the control element by the actuator into the unlocked position.

2. The lock system defined in claim 1 wherein the latch element is slidable between its holding and freeing positions.

3. The lock system defined in claim 1, further comprising a spring urging the control element into its unlocked position.

4. The lock system defined in claim 1 wherein the control element is at least partially hollow.

5. The lock system defined in claim 1 wherein the control element has an abutment face against which the actuator is directly engageable.

6. The lock system defined in claim 1 wherein the housing includes a guide and the control element is of U-section and straddles the guide.

7. The lock system defined in claim 1, further comprising a retaining element displaceable in the housing between a holding position preventing withdrawal of the actuator from the actuator port and a freeing position permitting such withdrawal; and means including interengaging formations on the retaining and control elements for displacing the retaining element into the holding position on displacement of the control element into the freeing position.

8. The lock system defined in claim 7, further comprising a spring braced between the retaining element and the housing and urging the retaining element into its holding position.

9. The lock system defined in claim 7 wherein the retaining element has a blocking formation engageable with the actuator in the holding position of the retaining element.

10. The lock system defined in claim 9 wherein the blocking formation is a projection engaging through the actuator.

11. The lock system defined in claim 1 wherein the housing includes a guide block on which the control and latch elements are displaceable.

12. The lock system defined in claim 11 wherein the control element slides on the guide block.

13. The lock system defined in claim 12 wherein the formation of the control element is an angled cam surface engaging the latch element.

14. The lock system defined in claim 13 wherein the control element is formed with an angled slot having a flank forming the cam surface.

15. A lock system for securing a luggage or shopping cart to a tethered latch member, the lock system comprising:

a housing mounted on the cart and formed with an outwardly open latch port and a pair of actuating ports one of which is adapted for receiving a card or token-as actuator and the other of which is adapted for receiving a card as actuator, the latch member being insertable into the latch port;

a latch element movable between a holding position retaining the latch member against removal from the latch port and a freeing position permitting such removal;

a control element having respective actuating faces aligned in the housing with the respective actuating ports and movable on insertion of the respective actuator into the actuating port from a locked to an unlocked position;

a spring braced between the control element and the housing urging the control element into the unlocked position;

means including interengageable formations on the elements for displacing the latch element into the freeing position on displacement of the control element by the actuator into the unlocked position;

a retaining element having respective formations engageable with the respective actuators and being displaceable in the housing between a holding position preventing withdrawal of the actuator from the actuator port and a freeing position permitting such withdrawal;

a spring braced between the retaining element and the housing urging the retaining element into the respective holding position; and means including interengaging formations on the retaining and control elements for displacing the retaining element into the holding position on displacement of the control element into the freeing position.

* * * * *

UNITED STATES PATENT AND TRADEMARK OFFICE

CERTIFICATE OF CORRECTION

PATENT NO. : 5,377,806

DATED : January 3, 1995

INVENTOR(S) : Horst MERCHEL

It is certified that error appears in the above-identified patent and that said Letters Patent is hereby corrected as shown below:

Claim 3, lines 2 and 3, change "unlocked" to -- locked --.

Signed and Sealed this

Eighteenth Day of March, 1997

Bruce Lehman

*Attest:*

BRUCE LEHMAN

*Attesting Officer*

*Commissioner of Patents and Trademarks*